US012544621B2

(12) United States Patent
Phillips

(10) Patent No.: US 12,544,621 B2
(45) Date of Patent: Feb. 10, 2026

(54) THERAPEUTIC GLOVE

(71) Applicant: ATS Innovations Inc., Shelbyville, TN (US)

(72) Inventor: Téa Phillips, Shelbyville, TN (US)

(73) Assignee: ATS Innovations Inc., Shelbyville, TN (US)

( * ) Notice: Subject to any disclaimer, the term of this patent is extended or adjusted under 35 U.S.C. 154(b) by 11 days.

(21) Appl. No.: 18/622,124

(22) Filed: Mar. 29, 2024

(65) Prior Publication Data

US 2025/0303231 A1 Oct. 2, 2025

(51) Int. Cl.
*A63B 23/16* (2006.01)

(52) U.S. Cl.
CPC ..... *A63B 23/16* (2013.01)

(58) Field of Classification Search
CPC ..... A63B 21/4019; A63B 23/16
See application file for complete search history.

(56) References Cited

U.S. PATENT DOCUMENTS 8,491,447 B1 * 7/2013 Koranic ..... A63B 23/16 482/44
D842,942 S * 3/2019 Phillips ..... D21/684
10,646,749 B1 * 5/2020 Williams ..... A63B 23/16
10,672,291 B2 * 6/2020 Raimondi ..... G09B 15/06
2006/0211964 A1 * 9/2006 Farrell ..... A61F 5/0118 602/5
2015/0202514 A1 * 7/2015 Ervin ..... A63B 69/0059 473/450
2017/0027255 A1 * 2/2017 Gellis ..... A41D 19/02
2022/0218507 A1 * 7/2022 Moon ..... A61F 5/01
2022/0226183 A1 * 7/2022 Venkatesan ..... A63B 21/0059
2024/0207668 A1 * 6/2024 Neely ..... A63B 21/4019
2024/0225881 A1 * 7/2024 Katz ..... A63B 23/16

* cited by examiner

*Primary Examiner* — Zachary T Moore
(74) *Attorney, Agent, or Firm* — Andrew T. Ball; Patterson Intellectual Property Law, PC

(57) ABSTRACT

Disclosed herein are gloves comprising a glove body configured to retain the hand of a wearer in a compressed or partially compressed configuration, and a tension assembly. The tension assembly can be mounted at least in part to the backhand portion of the glove and can include one or more tension elements that extend along the fingers of the glove, and therefore of the wearer. The glove may also include a tension assembly mounted to the thumb portion of the glove. The tension elements can be adjustably loaded, such that they apply an adjustable force to oppose the movement of the hand, and particularly the closure of the fingers of the wearer. Thus, the glove can be used to train the grip strength of the wearer.

19 Claims, 5 Drawing Sheets

THERAPEUTIC GLOVE

BACKGROUND

The human hand can suffer from various impairments which cause swelling, discomfort, joint pain, and loss of grip strength and manual dexterity.

In some cases, such difficulties can be corrected by progressive strength training. That is, by opposing the movement of the hand, and particularly the fingers of the hand, during ordinary daily use and movement, the strength of the hand and fingers can be improved. Preferably, such solutions are available to a wearer during many portions of daily life. However, conventional grip training equipment can be bulky and difficult to carry, which may limit a user to grip training only in certain settings where such equipment is present or available, such as at a gym. Moreover, such grip training equipment may be difficult to adjust for a progressively higher load.

What is needed, then, is a readily adjustable article of handwear, such as a glove, which facilitates grip training and can be worn during everyday activity. Advantageously, such a glove may provide other therapeutic values when worn.

BRIEF SUMMARY

Disclosed herein are articles of handwear, and particularly gloves, configured to assist with rehabilitative progressive strength training for the grip of a human hand, and for therapeutic treatment of swelling, joint pain, loss of hand strength, and other conditions of the human hand. In a general aspect, these gloves may comprise a compressive glove portion configured to retain the hand of a wearer in a compressed or partially compressed state. The gloves may also comprise a tension assembly, consisting of a backhand anchor, one or more finger anchors, and one or more tension elements extending between the finger anchors and the backhand anchor. The tension elements may apply a variable resistive force to oppose the natural closure motion of a user's hand, thereby facilitating progressive strength training of the user's grip.

Certain aspects concern a glove, comprising: a palm portion; a backhand portion; four finger portions each having a front side and a rear side, and a thumb portion. The glove also comprises a backhand tension assembly. The backhand tension assembly comprises one or more finger anchors fixedly attached to a back side of a different one of the four finger portions, a backhand anchor fixedly attached to the backhand portion, and one or more tension elements extending between the finger anchors and the backhand anchor. The glove also comprises a thumb tension assembly comprising a thumb anchor fixedly attached to the thumb portion, a wrist anchor fixedly attached to the thumb portion, and a tension element extending between the thumb anchor and the wrist anchor of the thumb tension assembly. The tension elements are configured to provide an adjustable resistive force that opposes closure of the fingers or thumb of a wearer.

Certain aspects concern a glove, comprising an enclosure configured to receive a hand of a wearer, the enclosure defined by a palm portion of the glove, a backhand portion of the glove, and a plurality of finger portions each having a front side and a rear side. The glove also comprises a tension assembly comprising a backhand anchor fixedly attached to the backhand portion, a plurality of finger anchors corresponding to the plurality of finger portions, each finger anchor of the plurality of finger anchors fixedly attached to a different finger portion of the plurality of finger portions, and a plurality of tension elements corresponding to the plurality of finger anchors, each tension element extending between the backhand anchor and a different corresponding finger anchor. The enclosure is configured to retain the hand of the wearer in a compressed state. The tension elements are configured to provide an adjustable resistive force that opposes closure of the fingers of a wearer.

Numerous objects, features and advantages of the embodiments set forth herein will be readily apparent to those skilled in the art upon reading of the following disclosure when taken in conjunction with the accompanying drawings.

DETAILED DESCRIPTION

General Terms

Figure 1:
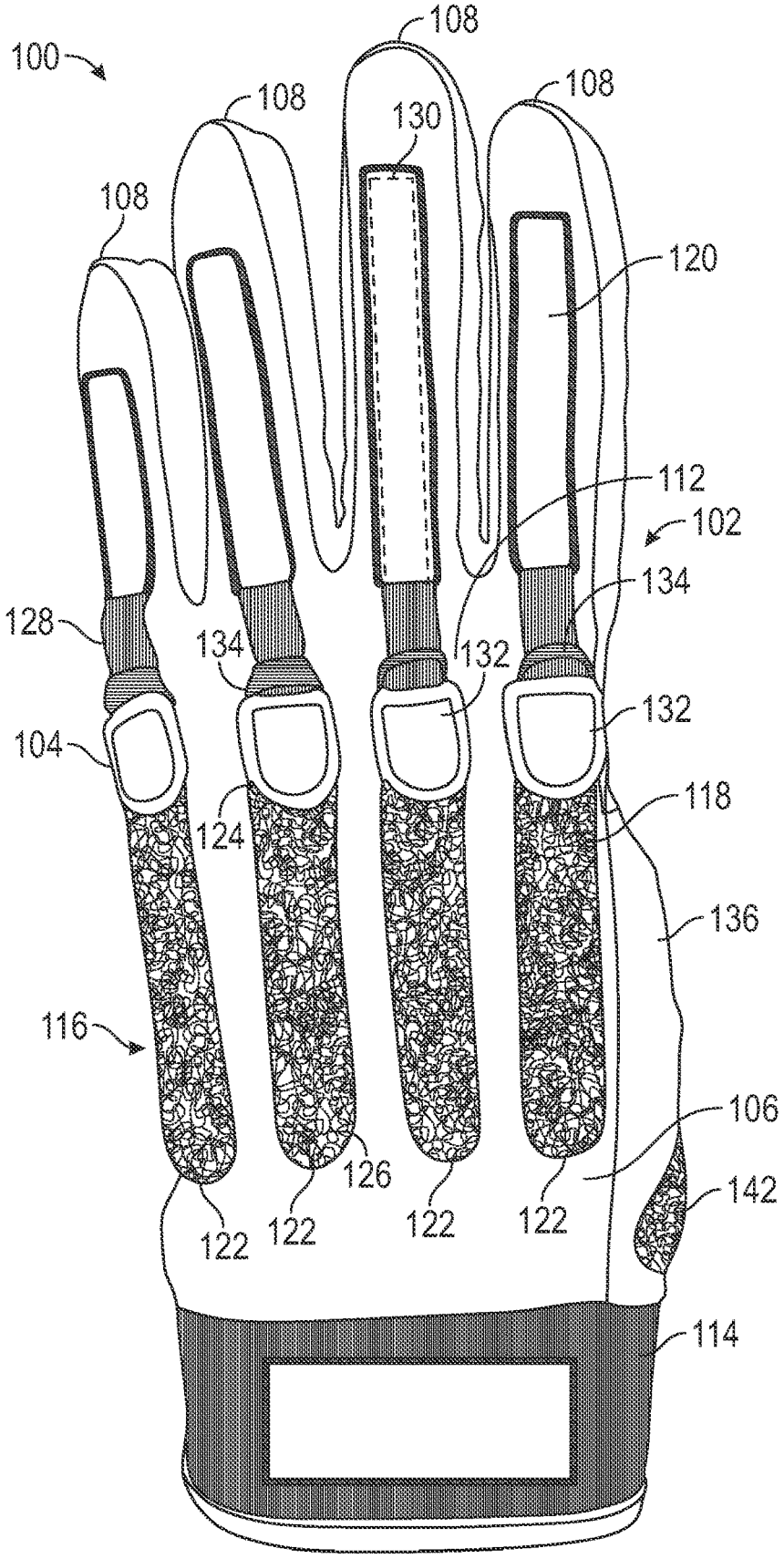
FIG. 1 is an elevation view of the rear side of a glove according to one aspect of the present disclosure.

The word "exemplary" is used herein to mean "serving as an example, instance, or illustration." Any implementation described herein as "exemplary" is not necessarily to be construed as preferred or advantageous over other implementations.

As used herein, the terms "first," "second," "third," and so on may be used interchangeably to distinguish one component from another and are not intended to signify location or importance of the individual components.

The terms "coupled," "fixed," "attached to," and the like refer both to direct coupling, fixing, or attaching, as well as indirect coupling, fixing, or attaching through one or more intermediate components or features, unless otherwise specified herein.

The singular forms "a," "an," and "the" include plural references, unless the context clearly indicates otherwise.

Unless otherwise indicated, all numbers expressing dimensions of components, percentages, temperatures, weights, and so forth, as used in the specification or claims are to be understood as being modified by the term "about." Accordingly, unless otherwise indicated, implicitly or explicitly, the numerical parameters set forth are approximations that can depend on ordinary manufacturing tolerances, minor design variations, or limits of the measuring technique used. When directly and explicitly distinguishing embodiments from discussed prior art, the embodiment numbers are not approximates unless the word "about" is recited. Furthermore, not all alternatives recited herein are equivalents.

Approximating language, as used herein throughout the specification and claims, is applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 1, 2, 4, 10, 15, or 20 percent margin.

Here and throughout the specification and claims, range limitations are combined and interchanged, such ranges are identified and include all the sub-ranges contained therein unless context or language indicates otherwise. For example, all ranges disclosed herein are inclusive of the endpoints, and the endpoints are independently combinable with each other.

Introduction to the Disclosed Technology

Disclosed herein are aspects of a glove, and particularly a therapeutic glove, comprising one or more tensioning elements configured to resistively oppose the closing of one or more of a wearer's fingers and/or the wearer's thumb. In some examples, the glove may further comprise a body configured to compress the hand of the wearer. Generally, the one or more tension elements can be adjustably connected to the body of the glove, such that the point of connection between the tension elements and the body of the glove. Thus, the tension elements form a tension assembly that provides an adjustable resistive force opposing the closure of the fingers of thumb of the wearer.

Advantageously, the combination of features disclosed herein allow a wearer to control the resistance against which the wearer's fingers pull in closing the hand. This allows for progressive strength training of the wearer's grip, with progressively increasing resistance to be applied as the wearer's grip strength is improved. Furthermore, by applying a tensile force opposing the closure of the wearer's fingers, the fingers can be retained in an open and/or extended configuration while the wearer is asleep, which can improve the health and comfort of the wearer's hands.

Aspects of the Disclosed Technology

Figure 3:
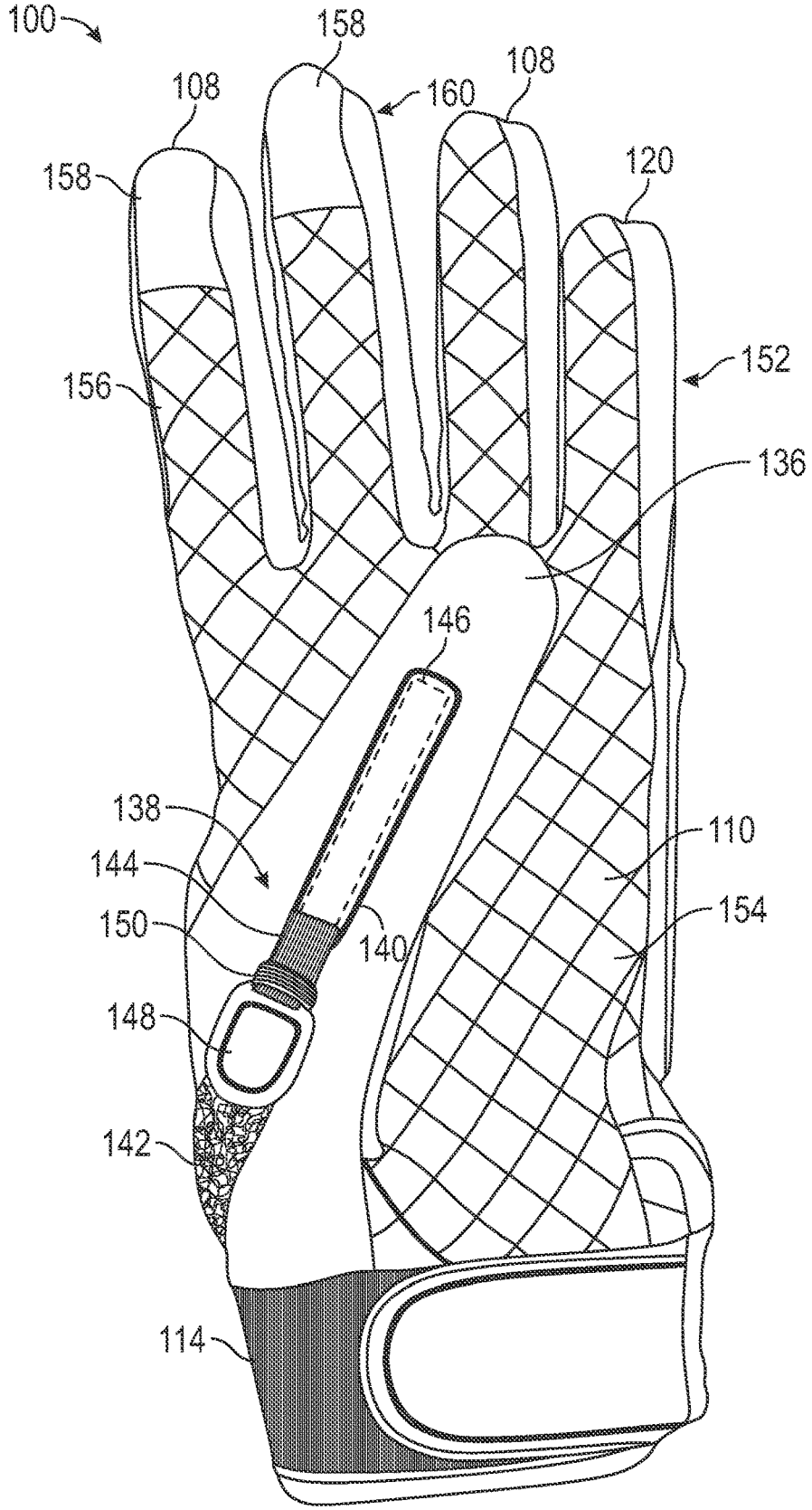
FIG. 3 is an elevation view of the front side of the glove of FIG. 1.

FIG. 1 shows a glove 100 according to one aspect of the present disclosure, as seen from the rear of the glove 100. The glove 100 comprises a glove body 102 and a tension assembly 104 (sometimes called a backhand tension assembly). The 102 comprises a backhand portion 106, a plurality of finger portions 108, and a palm portion 110 (as shown in FIG. 3), which together form an enclosure to receive a wearer's hand. According to some examples of the present disclosure, the glove 100 further comprises a knuckle portion 112 that extends between and connects the backhand portion 106 and the plurality of finger portions 108, and a wrist portion 114 which is positioned opposite to the knuckle portion 112 across the backhand portion 106 of the glove 100. In some examples, the glove body 102 can also comprise a lateral portion 115 that extends between the backhand portion 106 and the palm portion 110.

According to one example of the present disclosure, the tension assembly 104 is mounted to a rear side 116 of the glove body 102. As will be discussed in greater detail herein, the tension assembly 104 is configured to provide a resistive force opposing the closure of the fingers of a wearer, and thereby train and/or rehabilitate the grip strength of the wearer.

More particularly, the tension assembly 104 comprises a backhand anchor 118 and one or more finger anchors 120. The backhand anchor 118 is, in some examples, mounted to the backhand portion 106 of the glove 100 and the one or more finger anchors 120 can each be mounted to one of the plurality of finger portions 108, as shown in FIG. 1. In some examples, such as those shown in FIGS. 1 and 4A-4D, each of the one or more finger anchors 120 is attached to a separate finger portion 108 of the glove body 102. According to one aspect of the present disclosure, such as that illustrated in FIGS. 1-3, the number of the one or more finger anchors 120 can match the number of the plurality of finger portions 108, such that each finger portion 108 has an attached finger anchor 120. However, it will be readily appreciated that, in some examples, the number of finger anchors 120 can be less than the number of finger portions 108, such that only some finger portions 108 have an attached finger anchor 120.

In some examples, such as that illustrated in FIG. 1, the backhand anchor 118 can comprise a plurality of separated or individual anchoring strips 122. In some examples, such as those illustrated in FIGS. 4C and 4D, the backhand anchor 118 can instead comprise a single body, or a plurality of conjoined anchoring strips 122.

According to one aspect of the present disclosure, the backhand anchor 118 extends from the knuckle portion 112 towards the wrist portion 114. More particularly, the backhand anchor 118 (or, in examples in which the backhand anchor 118 comprises a plurality of separated or conjoined anchoring strips 122, the anchoring strips 122) have a first end portion 124 connected to the backhand portion 106 at a location that is at or adjacent to the knuckle portion 112, and a second end portion 126 that extends away from the first end portion 124 towards the wrist portion 114 of the glove body 102. It will be appreciated that, in some examples, such as those illustrated in FIGS. 4B-4D, the backhand anchor 118 can extend fully from the knuckle portion 112 to the wrist portion 114 (that is, the second end portion 126 can attach to the rear side 116 of the glove body 102 at or adjacent to the wrist portion 114), In other examples of the present disclosure, such as those illustrated in FIGS. 1-3 and 4A, the backhand anchor 118 can extend only partially from the knuckle portion 112 towards the wrist portion 114 (that is, the second end portion 126 can attach to a region of the backhand portion 106 positioned away from the knuckle portion 112 and towards the wrist portion 114).

According to one aspect of the present disclosure, the tension assembly 104 further comprises one or more tension elements 128, which extend between the one or more finger anchors 120 and the backhand anchor 118. In some examples, the tension elements 128 can be elastic bands, but it is to be understood that the tension elements 128 can be other devices suitable for resisting a tensile load. As shown in FIG. 1, the tension elements 128 can be attached at a fixed end portion 130 either to a finger anchor 120 or to a finger portion 108, such that each of the tension elements 128 extends from a different finger portion 108 to the backhand anchor 118. In some examples, the number of tension elements 128 can correspond to the number of finger portions 108 of the glove body 102, such that each finger portion 108 (or finger anchor 120 attached to the finger portion 108) can have one tension element 128 extending between it and the backhand anchor 118. However, it is to be understood that, in some examples, the number of tensioning elements 128 can be less than the number of finger portions 108 of the glove body 102 such that one or more of the finger portions 108 has no attached tensioning elements 128.

According to some examples, the one or more tension elements 128 can be permanently attached to the finger portion 108 and/or to the finger anchor 120 attached to the finger portion 108 from which it extends. The fixed attachment may be accomplished by, for example, stitching the tension element 128 to either the finger portion 108 or the finger anchor 120, or to both the finger portion 108 and the finger anchor 120. However, it is to be understood that in other examples, it may be possible to fixedly attach the tension elements 128 to the corresponding finger portions 108 and/or finger anchors 120 by other methods, such as gluing, or by integrally forming the tension elements 128 with either the finger portions 108 of the glove body 102 or the finger anchors 120.

As shown in FIG. 1, the tension elements 128 can extend along the full length or nearly the full length of the finger anchor 120 from which they extend. However, it is to be understood that, in some examples, the tension elements 128 can extend along a shorter length of the finger anchor 120 from which they extend. Advantageously, this can allow the position on the finger to which the adjustable resistive force of the tension elements 128 is applied to be adjusted by adjusting the length of the tension elements 128 (and thus, the portions of the finger portion 108 to which the adjustable resistive force is directly applied).

With continued reference to FIG. 1, the tension elements 128 can be releasably attached to the backhand anchor 118 or to the anchoring strips 122 that make up the backhand anchor 118 at a free end portion 132 of the tensioning elements 128. The free end portion 132 of the tension elements 128 is, according to one aspect of the present disclosure, releasably attached to the backhand anchor 118 or the anchoring strips 122 that make up the backhand anchor 118. For example, the anchoring strips 122 and/or the backhand anchor 118 can comprise the loop portion of a hook and loop fastening assembly, and the free end portion 132 can comprise a corresponding hook portion of a hook and loop fastening assembly.

The releasable attachment of the free end portion 132 of the tension elements 128 to the backhand anchor 118 allows for the point along the backhand anchor 118 at which each of the tension elements 128 is attached to be easily adjusted. This allows a different level of tension to be applied to each of the tension elements 128, which in turn allows for the resistive force applied by the tension elements 128 against the closure of the user's fingers to be adjusted. Particularly, when the free end portion 132 of a tension element 128 is attached to the backhand anchor 118 at a position that is closer to the knuckle portion 112, the tension of the tension element 128 (and accordingly, the resistive force applied in opposition to the closure of the fingers of the wearer) will be lower or reduced. Likewise, when the free end portion 132 of a tension element 128 is attached to the backhand anchor 118 at a position that is closer to the wrist portion 114, the tension of the tension element 128 (and accordingly, the resistive force applied in opposition to the closure of the fingers of the wearer) will be higher or increased.

Advantageously, this combination of features allows for a different resistance to be applied to the fingers of the wearer, depending on the needs of that wearer. For example, a user that is beginning grip training and/or therapy may benefit from a comparatively low resistive force and may accordingly attach the free end portion 132 of the tension elements 128 to a portion of the backhand anchor 118 that is closer to the knuckle portion 112 of the glove body 102. Then, as that user's grip strengthens, they may progressively increase the resistance provided by the glove 100 by attaching the free end portion 132 of the tension elements 128 to locations on the backhand anchor 118 that are progressively closer to the wrist portion 114.

While the example shown in FIG. 1 shows a backhand anchor 118 that uses a hook and loop fastener to facilitate the adjustable positioning of the attachment of the free end portion 132 of the tension elements 128 to the backhand anchor 118, it will be understood that alternative methods of releasably attaching the free end portion 132 of the tension elements 128 to the backhand anchor 118 may be used. For example, snaps, buttons, or clips may also be used, as will be appreciated by one of skill in the art.

According to one aspect of the present disclosure, and as shown in FIG. 1, the backhand anchor 118 can further comprise one or more guide loops 134. As shown in FIG. 1, the guide loops 134 are positioned on the first end portion 124 of the anchoring strips 122 (or on the backhand anchor 118 adjacent to the knuckle portion 112 of the glove body 102), and each receive one of the tension elements 128, which passes through the guide loop 134. When a tension element 128 passes through a guide loop, the linear alignment between the tension element 128 and the backhand anchor 118 (or particularly, the anchoring strips 122) can be improved.

According to some examples of the present disclosure, the number of guide loops 134 can match the number of finger portions 108 and/or the number of tension elements 128, as shown in FIG. 1. However, it will be appreciated that, in some examples, a smaller number of guide loops may be present, such that some finger portions 108 and/or some tension elements 128 may not have a corresponding guide loop 134, such that some of the tension elements 128 may not extend through a guide loop.

The combination of the backhand anchor 118, the finger anchors 120, and the guide loops 134 can, according to some aspects of the present disclosure, ensure that, when the glove 100 is worn, the tension elements 128 are linearly aligned in parallel or substantially in parallel to the fingers of the wearer. Advantageously, this can ensure that the adjustable resistive force applied to the fingers of the wearer opposing the closure of the wearer's hand is correctly aligned (that is, the force is applied is substantially in the plane of movement of the user's fingers as they close). Particularly this combination of features ensures that the force is applied directly opposite to the motion of a wearer's closing fingers, which offers benefits in improving the efficiency of grip training and avoiding placing undue strain on the fingers of the wearer.

In some examples, each of the tension elements 128 can comprise identical or substantially identical materials or dimensions, such that each of the tension elements 128 provides a substantially identical resistance under a substantially similar attachment location. However, it will be appreciated that in some examples, it will be possible for one or more of the tension elements to be designed with more rigid or less rigid elastic materials, and/or different dimensions, to provide correspondingly more or less resistance to the closure of the wearer's fingers, at any given attachment location.

Figure 2:
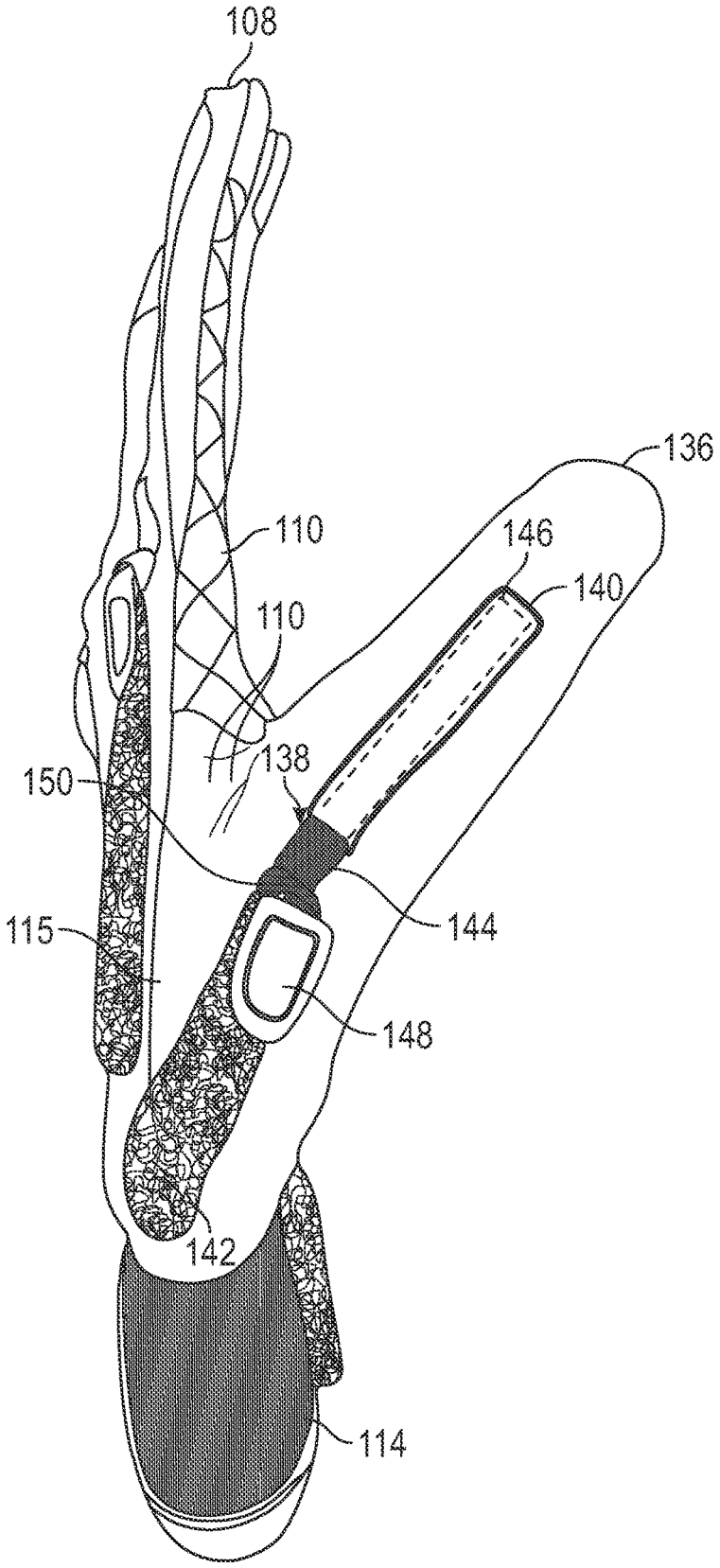
FIG. 2 is an elevation view of the right side of the glove of FIG. 1

According to one aspect of the present disclosure, the glove body 102 of the glove 100 further comprises a thumb portion 136, as shown in FIGS. 2 and 3. The glove 100 can also include a thumb tension assembly 138, which is attached to the thumb portion thumb portion 136 and to portions of the backhand portion 106 close to the wrist portion 114.

As shown in FIG. 2, the thumb tension assembly 138 can comprise a thumb anchor 140 disposed on a region of the thumb portion 136 comparatively further from the wrist portion 114, and a wrist anchor 142 disposed on a region of the thumb portion 136 comparatively closer to the wrist portion 114 and/or at least partially on a part of the backhand portion 106 adjacent to the wrist portion 114. A tension element 144 extends between the thumb anchor 140 and the wrist anchor 142 as shown in FIG. 2 and can function in a substantially similar way to that previously discussed in relation to the tension elements 128 disposed on the backhand portion 106 of the glove 100.

With continuing reference to FIG. 2, the tension element 144 can be fixedly attached to the thumb portion 136 and/or the thumb tension assembly 138. Particularly, a first end portion 146 of the tension element 144 can extend lengthwise along the thumb portion 136, and can be fixedly (that is, permanently) attached to the thumb portion 136 and/or the thumb tension assembly 138, for example, by stitching or gluing as previously discussed in relation to the attachment of the tension elements 128 to the finger portions 108 and/or the finger anchors 120. It is to be understood that, as an alternative to stitching or gluing the tension element 144 to the thumb portion 136 and/or the thumb tension assembly 138, the tension element 144 can be integrally formed (that is, formed as a single piece) with the thumb portion 136 and/or the thumb tension assembly 138.

According to one aspect of the present disclosure, the tension element 144 is adjustably or releasably attached to the wrist anchor 142. Particularly, a second end portion 148 of the tension element 144 can be releasably attached to the thumb anchor 140 by any of the methods previously discussed in relation to the attachment of the tension elements 128 to the backhand anchor 118 (or to the anchoring strips 122 of the backhand anchor 118). For example, the wrist anchor 142 can comprise the loop portion of a hook and loop fastener, and the second end portion 148 can comprise a hook portion of the hook and loop fastener (or vice versa), allowing for the second end portion 148 to be easily detached from the thumb anchor 140 and reattached at any point along the length of the thumb anchor 140. It will also be understood that any of the other attachment mechanisms discussed in relation to the tension elements 128 will apply equally well to the releasable attachment of the tension element 144 to the thumb anchor 140.

Similar to the function previously discussed in relation to the tension elements 128 disposed along the rear side 116 of the glove 100, the tension element 144 is configured to apply a variable and adjustable resistive force to the closure of the wearer's thumb. More specifically, when then second end portion 148 is attached to the wrist anchor 142 closer to the thumb of the wearer, the tension element 144 is placed under a lower tension, and accordingly applies a lower or reduced force opposing the closure of the wearer's thumb. Likewise, when the second end portion 148 of the tension element 144 is attached to the wrist anchor 142 further from the thumb of the wearer (that is, closer to the wrist of the wearer), the tension element 144 is placed under a higher tension, and accordingly applies a higher or increased force opposing the closure of the wearer's thumb.

The thumb tension assembly 138 can further comprise a guide loop 150, that is substantially similar in function to the guide loops guide loops 134 previously discussed in relation to the tension assembly 104. Particularly, the guide loop 150 can receive the tension element 144 and ensure the alignment of the tension element 144 with the back of the thumb of the wearer, such that the closure of the wearer's thumb is directly opposed by the resistive force applied by the tension element 144 (that is, the force is applied substantially in the plane of movement of the user's thumb as it closes).

According to one aspect of the present disclosure, the glove body 102 can include one or more additional features as disclosed herein. For example, as shown in FIG. 3, a front portion 152 of the glove body 102 can comprise a grip pattern 154 disposed on the palm portion 110 and on a front side 156 of the finger portions finger portion 108. The grip pattern 154 can comprise an elastomeric grip material or other soft, flexible material selected to provide texture and improve the ability of the wearer of the glove 100 to grip objects while wearing the glove 100.

According to one example of the present disclosure, the front side 156 of the finger portions 108 can further include one or more touchscreen-compatible portions 158. The one or more touchscreen-compatible portions 158 comprise a material which is recognized and responded to when in contact with a touchscreen and are positioned towards a tip portion 160 of one or more of the finger portions 108. For example, as shown in FIG. 3, a touchscreen-compatible portion 158 can be positioned at the tip portion 160 of two of the four finger portions 108. In some examples, a greater or lesser number of finger portions 108 may include a touchscreen-compatible portion 158, such as one, three, or four finger portions 108. Additionally, it will be appreciated that according to some aspects of the present disclosure, the thumb portion 136 of the glove may also include a one or more touchscreen-compatible portions 158.

According to one aspect of the present disclosure, the 102 can be configured to retain the hand of the wearer in a compressed or partially compressed state. Particularly, one or more of the various regions of the backhand portion 106, the finger portion 108, the palm portion 110, the knuckle portion 112, and the thumb portion 136 can comprise a material that can stretch in one or more directions, and preferably in at least two directions, such as elastane fabrics or other suitably stretchable material. The glove body 102 may then be sized so that the cavity defined by the various portions of the glove body 102, which receives the user's hand, will be slightly smaller than the user's hand. When the user places their hand within the cavity glove body 102, the elastic material of the one or more portions comprising such material will stretch to accommodate the user's hand. In turn, this compresses the user's hand. Advantageously, when the glove 100 is configured to retain the user's hand in a state of compression in this fashion, the glove 100 may offer one or more therapeutic advantages, such as the reduction of swelling, pain, and stiffness in the hands of the wearer.

While the various portions and regions of the glove body 102, such as the backhand portion 106, the finger portion 108, the palm portion 110, the knuckle portion 112, the wrist portion 114, and the thumb portion 136 disclosed herein have been individually introduced, and discussed in relation to one another, it will be understood by one of skill in the art that, in some examples, any or all of these components may be unitarily formed (that is, fabricated as a single piece). Likewise, it will be understood that in other examples, any or all of these portions of the glove body 102 can be separately fabricated, and subsequently joined together, permanently or releasably, to form the glove body 102.

Also disclosed herein in greater detail, and schematically illustrated in FIGS. 4A-4D, are several potential configurations for the tension assembly 104 and/or the thumb tension assembly 138.

Figure 4B:
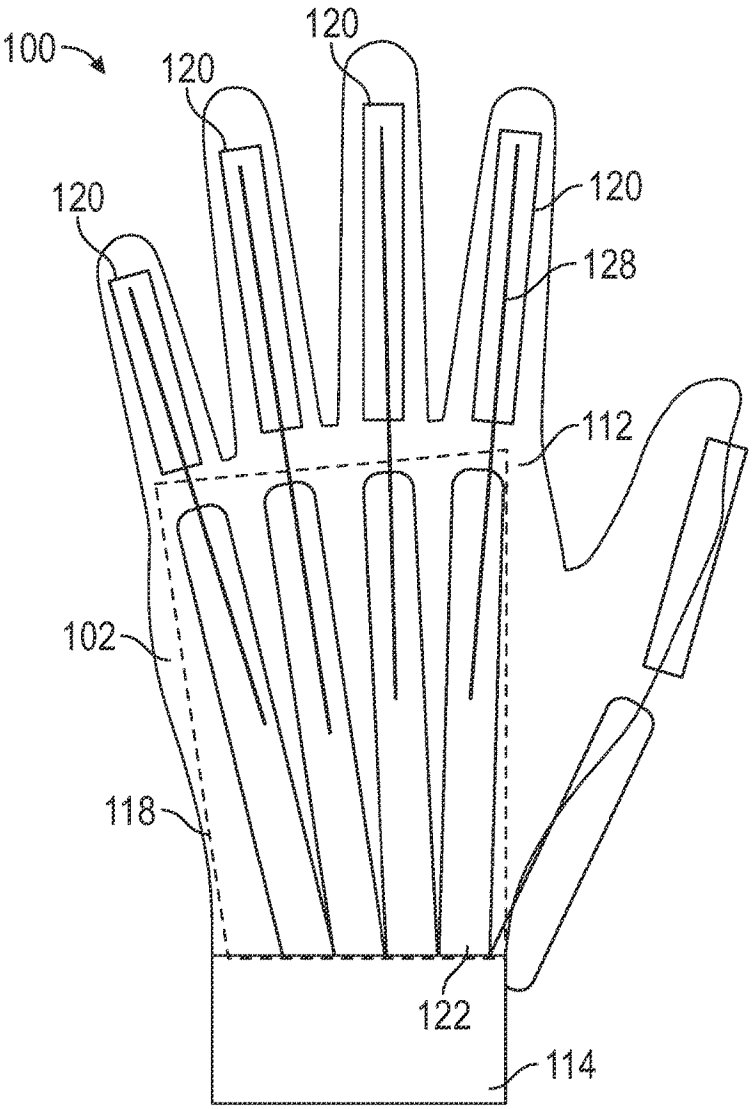
FIG. 4B is a schematic view of a tension assembly according to another aspect of the present disclosure.
Figure 4A:
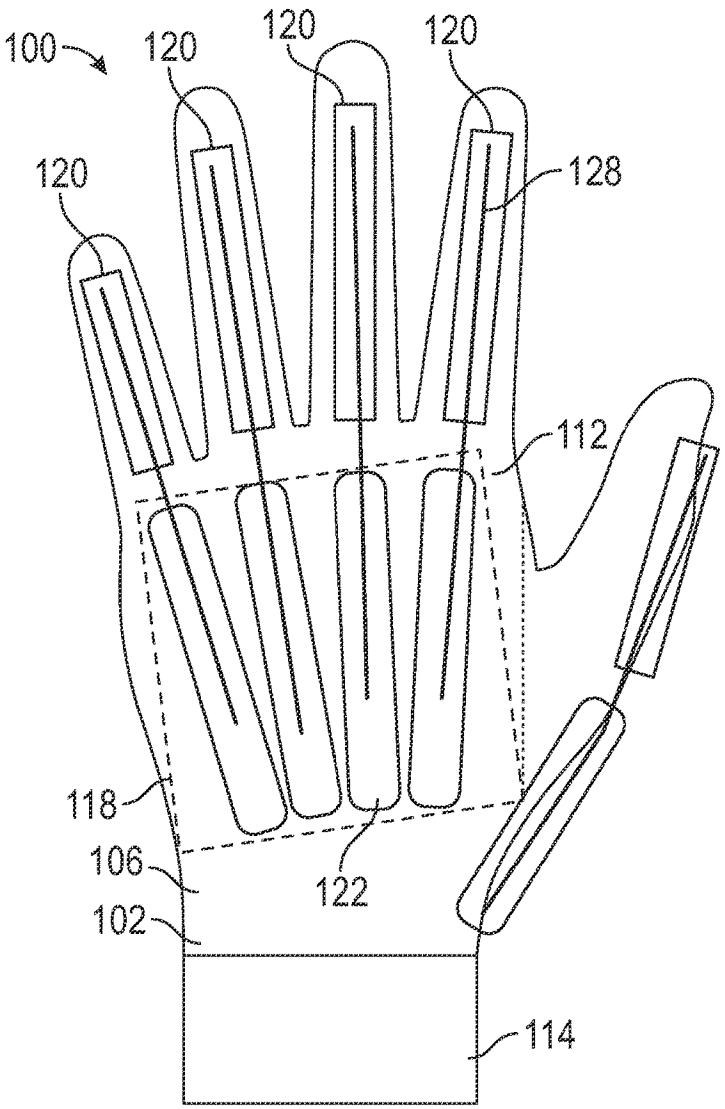
FIG. 4A is a schematic view of a tension assembly according to one aspect of the present disclosure.

For example, as illustrated in FIG. 4A, the glove 100 can include a backhand anchor 118 that comprises a plurality of separate (that is, not conjoined), laterally spaced apart anchoring strips 122 extending from the knuckle portion 112 of the glove body 102 towards, but not fully to, the wrist portion 114 of the glove body 102. Thus, part of the backhand portion 106 of the glove body 102 separates the anchoring strips 122 of the backhand anchor 118 from the wrist portion 114.

In another aspect of the present disclosure, illustrated in FIG. 4B, the glove 100 can include a backhand anchor 118 that comprises a plurality of separate (that is, not conjoined), laterally spaced apart anchoring strips 122 extending fully from the knuckle portion 112 of the glove body 102 to the wrist portion 114 of the glove body 102. Thus, the anchoring strips 122 that make up the backhand anchor 118 terminate at the knuckle portion 112 of the glove body 102 at one end, and at the wrist portion 114 of the glove body 102 at the other end. Advantageously, this may improve the range of adjustability of the resistive force provided by the tension elements 128, by allowing additional tension to be applied to the tension elements 128. Additionally, this may assist in preventing the backhand anchoring strips 122 from lifting away from the glove body 102 when attached to the tensioning elements, which may in turn help the fabric of the 102 retain an original shape, by minimizing the chance of ripping or stretching.

Figure 4D:
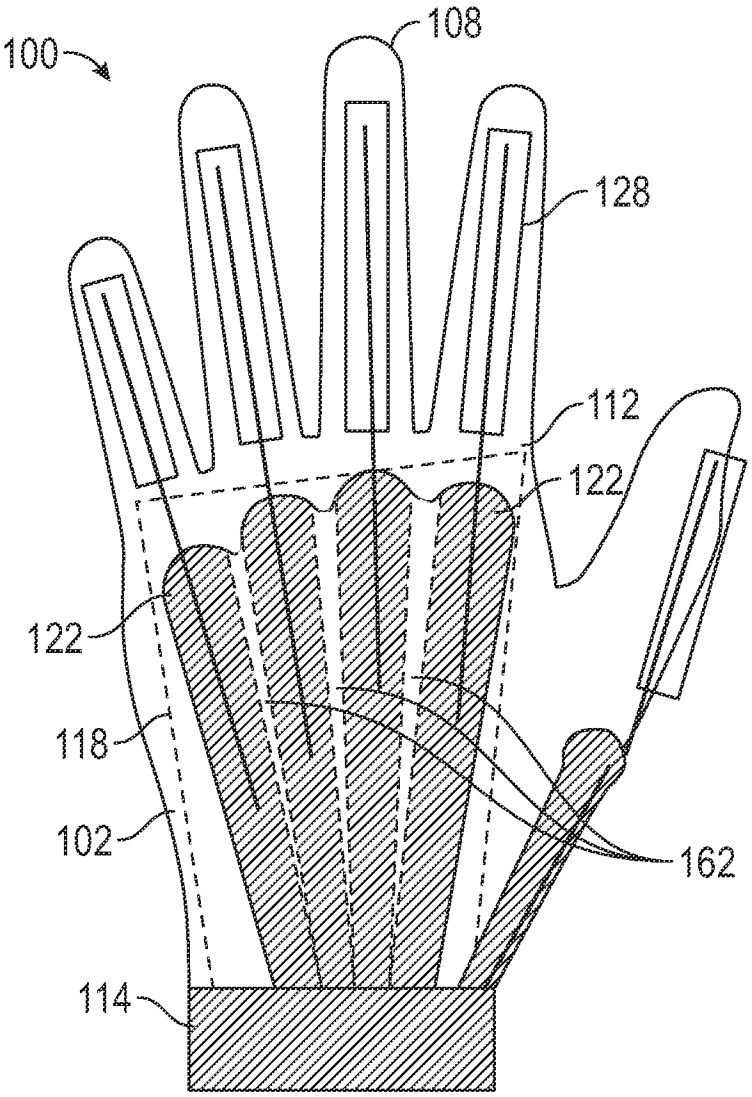
FIG. 4D is a schematic view of a tension assembly according to another aspect of the present disclosure.
Figure 4C:
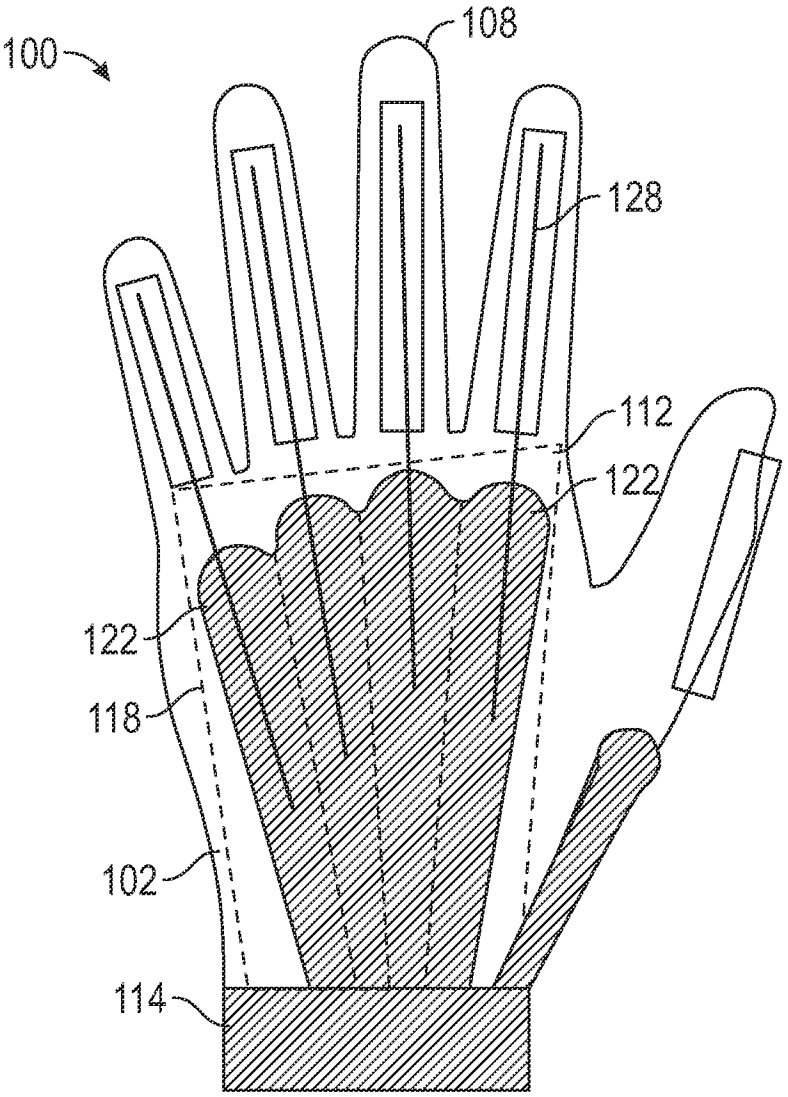
FIG. 4C is a schematic view of a tension assembly according to another aspect of the present disclosure.

In another aspect of the present disclosure, illustrated in FIG. 4C, the glove 100 can include a backhand anchor 118 that comprises a plurality of conjoined anchoring strips 122 that are immediately adjacent to one another, and extend fully from the knuckle portion 112 of the glove body 102 to the wrist portion 114 of the glove body 102. Thus, the anchoring strips 122 that make up the backhand anchor 118 terminate at the anchoring strips 122 of the glove body 102 at one end, and at the wrist portion 114 of the glove body 102 at the other end. Advantageously, this may improve the range of adjustability of the resistive force provided by the tension elements 128, by allowing additional tension to be applied to the tension elements 128. Additionally, this may assist in preventing the backhand anchoring strips 122 from lifting away from the glove body 102 when attached to the tensioning elements, which may in turn help the fabric of the 102 retain an original shape, by minimizing the chance of ripping or stretching.

In another aspect of the present disclosure, illustrated in FIG. 4D, the glove 100 can include a backhand anchor 118 that comprises a plurality of conjoined anchoring strips 122 that are interconnected by a plurality of flexible elastic regions 162, and extend fully from the knuckle portion 112 of the glove body 102 to the wrist portion 114 of the glove body 102. Thus, the anchoring strips 122 that make up the backhand anchor 118 terminate at the anchoring strips 122 of the glove body 102 at one end, and at the wrist portion 114 of the glove body 102 at the other end. Advantageously, this may improve the range of adjustability of the resistive force provided by the tension elements 128, by allowing additional tension to be applied to the tension elements 128. Additionally, this may assist in preventing the backhand anchoring strips 122 from lifting away from the glove body 102 when attached to the tensioning elements, which may in turn help the fabric of the 102 retain an original shape, by minimizing the chance of ripping or stretching.

Thus, it is seen that the various disclosed features readily achieve the ends and advantages mentioned as well as those inherent therein. While certain preferred embodiments of the disclosure have been illustrated and described for present purposes, numerous changes in the arrangement and construction of parts and steps may be made by those skilled in the art, which changes are encompassed within the scope and spirit of the present disclosure as defined by the appended claims. Each disclosed feature or embodiment may be combined with any of the other disclosed features or embodiments.

Additional Examples of the Disclosed Technology

This written description uses examples to illustrate the various aspects of the disclosed technology, and to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

Example 1. A glove, comprising a palm portion; a backhand portion; four finger portions each having a front side and a rear side; a thumb portion, and; a backhand tension assembly comprising one or more finger anchors fixedly attached to a back side of a different one of the four finger portions, a backhand anchor fixedly attached to the backhand portion, and one or more tension elements extending between the finger anchors and the backhand anchor; a thumb tension assembly comprising a thumb anchor fixedly attached to the thumb portion, a wrist anchor fixedly attached to the thumb portion, and a tension element extending between the thumb anchor and the wrist anchor of the thumb tension assembly, wherein the tension elements are configured to provide an adjustable resistive force that opposes closure of the fingers or thumb of a wearer.

Example 2. The glove of any example herein, particularly example 1, wherein the glove further comprises a knuckle portion disposed between the backhand portion and the finger portions, and a wrist portion positioned opposite the knuckle portion across the backhand portion of the glove, and wherein the backhand anchor of extends from the knuckle portion to the wrist portion of the glove.

Example 3. The glove of any example herein, particularly example 2, wherein the backhand anchor comprises a plurality of laterally spaced apart anchoring strips, and an elastic material extending between the anchoring strips of the tension assembly.

Example 4. The glove of any example herein, particularly example 2, wherein each tensioning element of the one or more tensioning elements comprises a first end portion that extends along and is fixedly attached to a corresponding finger portion.

Example 5. The glove of any example herein, particularly example 4, wherein the tensioning elements of the backhand tension assembly each comprise a free end portion configured to releasably attach the tensioning element to the backhand anchor.

Example 6. The glove of any example herein, particularly example 5, wherein when the free end portion of the tensioning element is attached to the backhand anchor in a position closer to the knuckle portion of the glove, the adjustable resistive force is reduced, and when the free end portion of the tensioning element is attached in a position further from the knuckle portion of the glove, the adjustable resistive force is increased.

Example 7. The glove of any example herein, particularly example 1, wherein the tension element is an elastic band.

Example 8. The glove of any example herein, particularly example 1, wherein the palm portion, the backhand portion, the finger portions, and the thumb portion together form an enclosure configured to receive a hand of the wearer and retain the hand of the wearer in a partially compressed state when the glove is worn.

Example 9. The glove of any example herein, particularly example 1, further comprising one or more touchscreen-compatible portions disposed on a tip portion of one or more corresponding finger portions.

Example 10. The glove of any example herein, particularly example 1, wherein the palm portion comprises an elastomeric grip material.

Example 11. The glove of any example herein, particularly example 1, further comprising one or more guide loops attached to a corresponding number of anchoring strips, such that each guide loop receives a tension element extending between the corresponding anchoring strip and the finger anchor to which it is attached.

Example 12. The glove of any example herein, particularly example 1, wherein the glove further comprises a knuckle portion disposed between the backhand portion and the finger portions, and a wrist portion positioned opposite the knuckle portion across the backhand portion of the glove, and wherein the backhand anchor of each tension assembly extends from the knuckle portion of the glove towards the wrist portion of the glove, but does not extend fully to the wrist portion of the glove.

Example 13. A glove, comprising: an enclosure configured to receive a hand of a wearer, the enclosure defined by a palm portion of the glove, a backhand portion of the glove, and a plurality of finger portions each having a front side and a rear side; a tension assembly comprising a backhand anchor fixedly attached to the backhand portion, a plurality of finger anchors corresponding to the plurality of finger portions, each finger anchor of the plurality of finger anchors fixedly attached to a different finger portion of the plurality of finger portions, and a plurality of tension elements corresponding to the plurality of finger anchors, each tension element extending between the backhand anchor and a different corresponding finger anchor, wherein the enclosure is configured to retain the hand of the wearer in a compressed state, and wherein the tension elements are configured to provide an adjustable resistive force that opposes closure of the fingers of a wearer.

Example 14. The glove of any example herein, particularly example 13, further comprising a lateral portion extending between the palm portion and the backhand portion.

Example 15. The glove of any example herein, particularly example 14, further comprising a thumb portion and a thumb tension assembly, the thumb tension assembly comprising a thumb anchor fixedly attached to the thumb portion, a wrist anchor fixedly attached to the glove between the thumb portion and the wrist portion, and a tension element extending between the thumb anchor and the wrist anchor, and configured to provide an adjustable resistive force opposing the closure of the thumb of the wearer.

Example 16. The glove of any example herein, particularly example 13, wherein each tension element of the plurality of tension elements comprises an end portion that is fixedly attached to a different finger portion.

Example 17. The glove of any example herein, particularly example 13, wherein each tension element comprises an end portion that is adjustably attached to the backhand anchor, and wherein adjusting a position of the end portion relative to the backhand anchor adjusts the resistive force opposing the closure of the fingers of the wearer.

Example 18. The glove of any example herein, particularly example 13, further comprising a knuckle portion disposed between the backhand portion and the plurality of finger portions, and a wrist portion positioned opposite the knuckle portion across the backhand portion, and wherein backhand anchor extends from a knuckle portion to the wrist portion.

Example 19. The glove of any example herein, particularly example 13, further comprising a knuckle portion disposed between the backhand portion and the plurality of finger portions, and a wrist portion positioned opposite the knuckle portion across the backhand portion, and wherein backhand anchor extends partially from the knuckle portion towards the wrist portion.

Example 20. The glove of any example herein, particularly example 13, wherein the backhand anchor comprises a plurality of laterally spaced apart anchoring strips.

Thus, although there have been described particular embodiments of the present invention of a new and useful therapeutic glove it is not intended that such references be construed as limitations upon the scope of this invention except as set forth in the following claims.

What is claimed is:

1. A glove, comprising:
- a palm portion;
- a backhand portion;
- four finger portions each having a front side and a rear side;
- a thumb portion, and;
- a backhand tension assembly comprising:
  - one or more finger anchors fixedly attached to a back side of a different one of the four finger portions;
  - a backhand anchor fixedly attached to the backhand portion and comprising a plurality of laterally spaced apart anchoring strips, and an elastic material extending between the anchoring strips of the tension assembly; and
  - one or more tension elements extending between the finger anchors and the backhand anchor; and
- a thumb tension assembly comprising a thumb anchor fixedly attached to the thumb portion, a wrist anchor fixedly attached to the thumb portion, and a tension element extending between the thumb anchor and the wrist anchor of the thumb tension assembly,
- wherein the tension elements are configured to provide an adjustable resistive force that opposes closure of the fingers or thumb of a wearer.

2. The glove of claim 1, wherein the glove further comprises a knuckle portion disposed between the backhand portion and the finger portions, and a wrist portion positioned opposite the knuckle portion across the backhand portion of the glove, and wherein the backhand anchor of extends from the knuckle portion to the wrist portion of the glove.

3. The glove of claim 2, wherein each tensioning element of the one or more tensioning elements comprises a first end portion that extends along and is fixedly attached to a corresponding finger portion.

4. The glove of claim 3, wherein the tensioning elements of the backhand tension assembly each comprise a free end portion configured to releasably attach the tensioning element to the backhand anchor.

5. The glove of claim 4, wherein when the free end portion of the tensioning element is attached to the backhand anchor in a position closer to the knuckle portion of the glove, the adjustable resistive force is reduced, and when the free end portion of the tensioning element is attached in a position further from the knuckle portion of the glove, the adjustable resistive force is increased.

6. The glove of claim 1, wherein the tension element is an elastic band.

7. The glove of claim 1, wherein the palm portion, the backhand portion, the finger portions, and the thumb portion together form an enclosure configured to receive a hand of the wearer and retain the hand of the wearer in a partially compressed state when the glove is worn.

8. The glove of claim 1, further comprising one or more touchscreen-compatible portions disposed on a tip portion of one or more corresponding finger portions.

9. The glove of claim 1, wherein the palm portion comprises an elastomeric grip material.

10. The glove of claim 1, wherein the glove further comprises a knuckle portion disposed between the backhand portion and the finger portions, and a wrist portion positioned opposite the knuckle portion across the backhand portion of the glove, and wherein the backhand anchor of each tension assembly extends from the knuckle portion of the glove towards the wrist portion of the glove but does not extend fully to the wrist portion of the glove.

11. A glove, comprising:

an enclosure configured to receive a hand of a wearer, the enclosure defined by a palm portion of the glove, a backhand portion of the glove, and a plurality of finger portions each having a front side and a rear side;

a tension assembly comprising a backhand anchor fixedly attached to the backhand portion, a plurality of finger anchors corresponding to the plurality of finger portions, each finger anchor of the plurality of finger anchors fixedly attached to a different finger portion of the plurality of finger portions, and a plurality of tension elements corresponding to the plurality of finger anchors, each tension element extending between the backhand anchor and a different corresponding finger anchor, wherein the backhand anchor comprises a plurality of laterally spaced apart anchoring strips and an elastic material extending between the anchoring strips of the tension assembly, wherein the enclosure is configured to retain the hand of the wearer in a compressed state, and wherein the tension elements are configured to provide an adjustable resistive force that opposes closure of the fingers of a wearer.

12. The glove of claim 11, further comprising a lateral portion extending between the palm portion and the backhand portion.

13. The glove of claim 12, further comprising a thumb portion and a thumb tension assembly, the thumb tension assembly comprising a thumb anchor fixedly attached to the thumb portion, a wrist anchor fixedly attached to the glove between the thumb portion and the wrist portion, and a tension element extending between the thumb anchor and the wrist anchor, and configured to provide an adjustable resistive force opposing the closure of the thumb of the wearer.

14. The glove of claim 11, wherein each tension element of the plurality of tension elements comprises an end portion that is fixedly attached to a different finger portion.

15. The glove of claim 11, wherein each tension element comprises an end portion that is adjustably attached to the backhand anchor, and wherein adjusting a position of the end portion relative to the backhand anchor adjusts the resistive force opposing the closure of the fingers of the wearer.

16. The glove of claim 11, further comprising a knuckle portion disposed between the backhand portion and the plurality of finger portions, and a wrist portion positioned opposite the knuckle portion across the backhand portion, and wherein backhand anchor extends from a knuckle portion to the wrist portion.

17. The glove of claim 11, further comprising a knuckle portion disposed between the backhand portion and the plurality of finger portions, and a wrist portion positioned opposite the knuckle portion across the backhand portion, and wherein backhand anchor extends partially from the knuckle portion towards the wrist portion.

18. The glove of claim 11, wherein the backhand anchor comprises a plurality of laterally spaced apart anchoring strips.

19. A glove, comprising:

a palm portion;

a backhand portion;

four finger portions each having a front side and a rear side;

a thumb portion, and;

a backhand tension assembly comprising one or more finger anchors fixedly attached to a back side of a different one of the four finger portions, a backhand anchor fixedly attached to the backhand portion, and one or more tension elements extending between the finger anchors and the backhand anchor;

a thumb tension assembly comprising a thumb anchor fixedly attached to the thumb portion, a wrist anchor fixedly attached to the thumb portion, and a tension element extending between the thumb anchor and the wrist anchor of the thumb tension assembly; and one or more guide loops attached to a corresponding number of anchoring strips, such that each guide loop receives a tension element extending between the corresponding anchoring strip and the finger anchor to which it is attached;

wherein the tension elements are configured to provide an adjustable resistive force that opposes closure of the fingers or thumb of a wearer.

* * * * *